United States Patent [19]

Vetten

[11] 3,943,834

[45] Mar. 16, 1976

[54] APPARATUS FOR FOLDING AND FLAT-SEALING THE BOTTOM OF A LIQUID-PROOF PACKAGE

[75] Inventor: Wilhelm Vetten, Dusseldorf, Germany

[73] Assignee: Jagenberg Werke Aktiengesellschaft, Dusseldorf, Germany

[22] Filed: July 12, 1974

[21] Appl. No.: 488,602

[30] Foreign Application Priority Data

July 24, 1973 Germany ..... 2337449

[52] U.S. Cl. ..... 93/44.1 GT; 93/44.1 R

[51] Int. Cl.² ..... B31B 1/32

[58] Field of Search ..... 93/44.1 GT, 44.1 R, 39.2, 93/39.3, 49 R, 36 R, 39.1 P

[56] References Cited

UNITED STATES PATENTS

| | | | |
|---|---|---|---|
| 3,166,994 | 1/1965 | Egleston | 93/44.1 R |
| 3,212,413 | 10/1965 | Allen et al. | 93/44.1 GT |
| 3,252,386 | 5/1966 | Reimers | 93/44.1 R |
| 3,398,659 | 8/1968 | Egleston | 93/44.1 GT UX |
| 3,602,106 | 8/1971 | Allen | 93/44.1 R |

*Primary Examiner*—James F. Coan

*Attorney, Agent, or Firm*—Burgess, Dinklage & Sprung

[57] ABSTRACT

An apparatus for the folding and flat-sealing of the bottom of a liquid-proof package with a roof-shaped folded closure and inwardly folded gable walls starting with a tubular package blank, comprising a plurality of mandrels for carrying the blanks, means for advancing the mandrels progressively through a plurality of stations to be operated upon, means for folding gables on the blanks, and means for folding the roof on each blank after a gable folding operation, the means for folding the gables and the roof being positioned to operate on a blank in the course of the passage of said blank on a mandrel between two successive stations. Cams are provided so that while the operative members of the folding tools move relative to the blank in order to effect their folds, the points of initial contact between the operative members and blank are substantially maintained throughout the respective folding operation to minimize possiblity of damage to the coating with which such blanks are provided.

6 Claims, 11 Drawing Figures

Figures 3A, 3B, 4A, 4B:
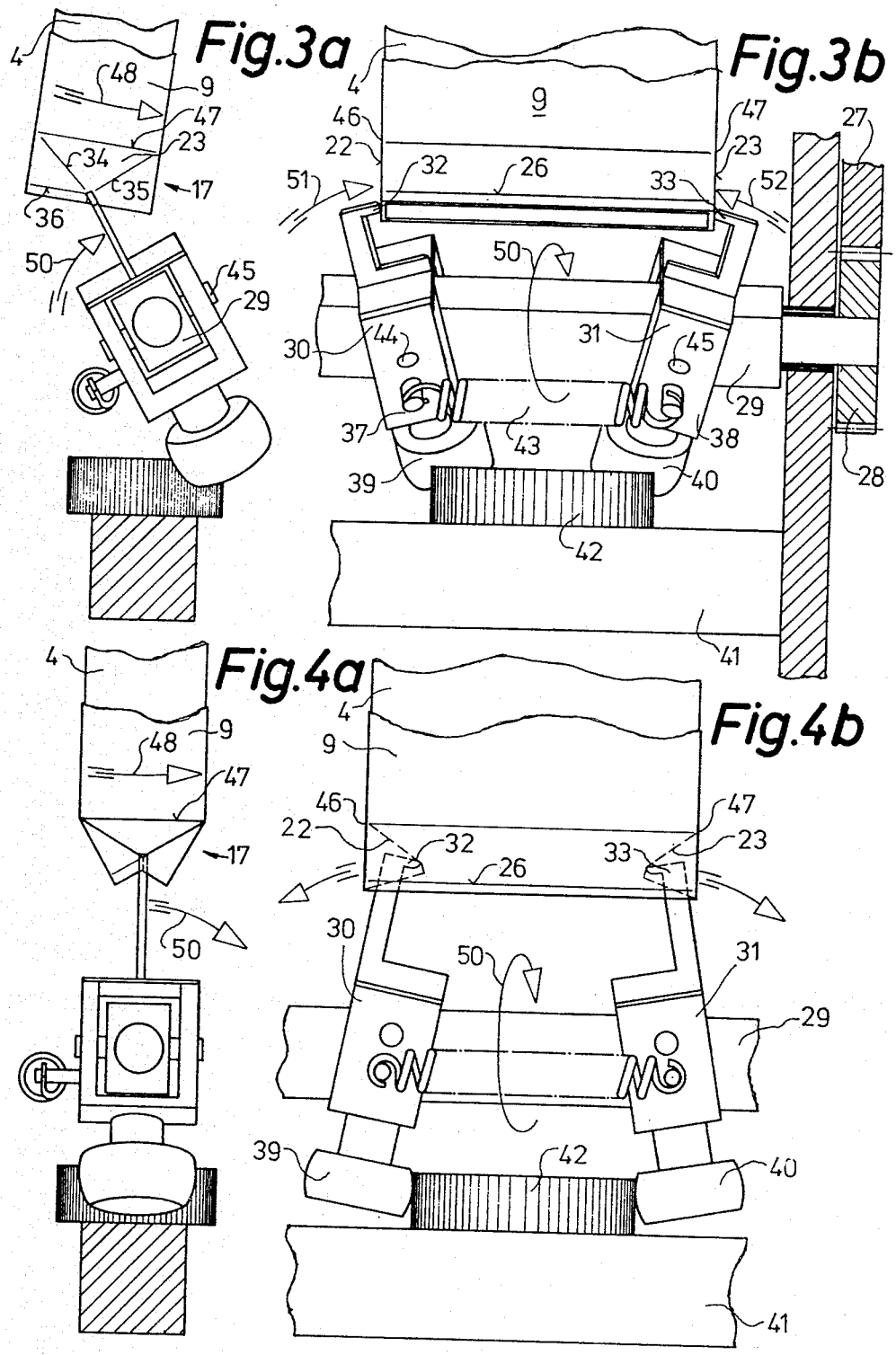

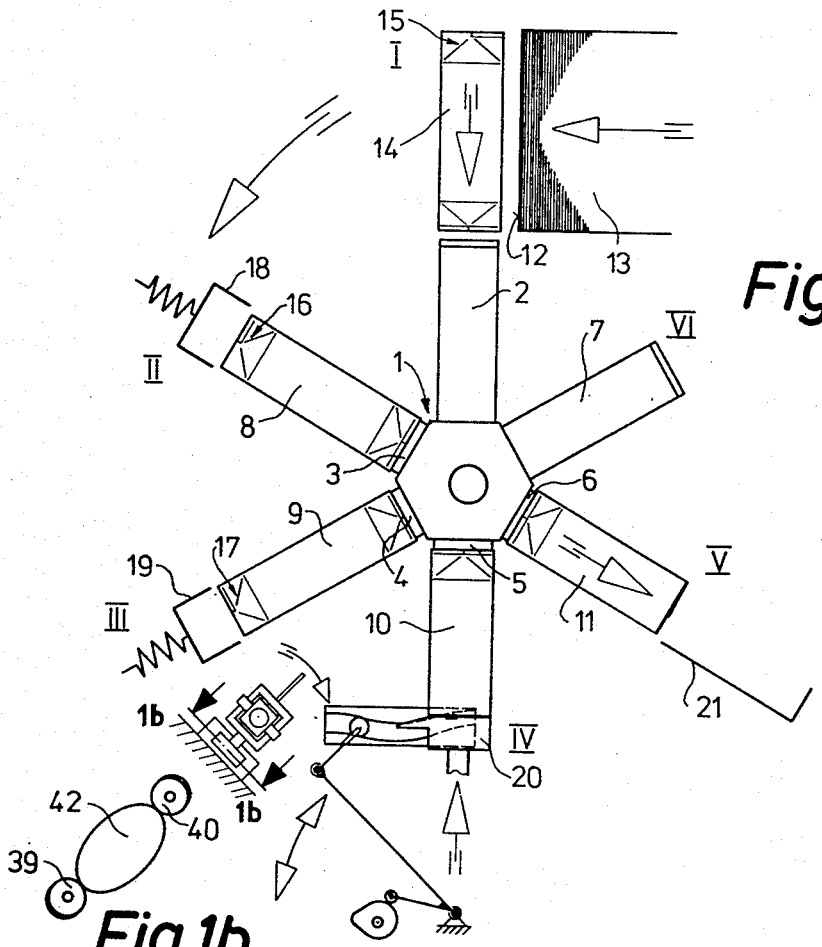
Fig.1a
Fig.1b
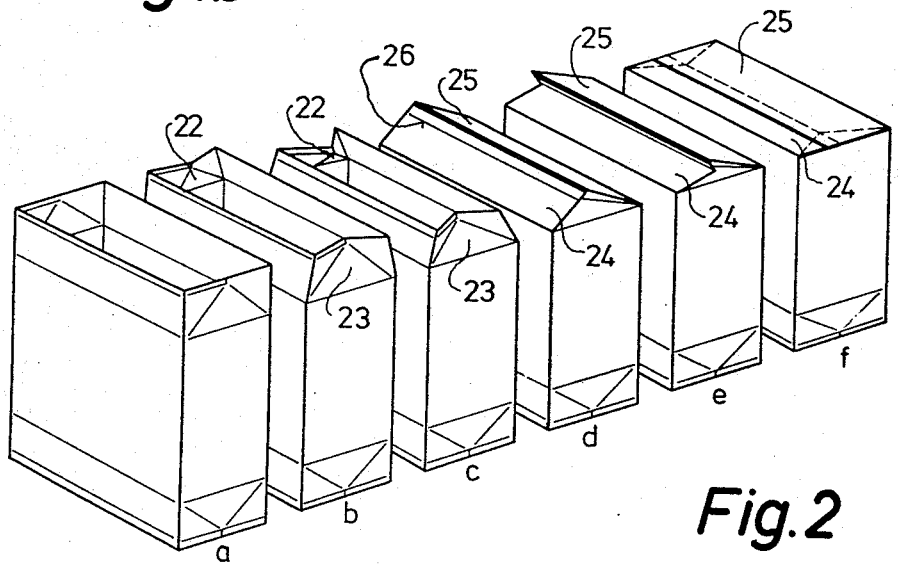
Fig.2

4
48
9
47
23
34
35
17
36
50
45
29
46
22
32
26
33
51
52
27
44
30
31
37
43
38
39
40
42
28
41

APPARATUS FOR FOLDING AND FLAT-SEALING THE BOTTOM OF A LIQUID-PROOF PACKAGE

BACKGROUND

The invention relates to an apparatus for folding and flat-sealing the bottom of a liquid-proof package having integral tuck-folded closures, the tubular blank of the package being placed on a mandrel wheel and the folding operation being effected by fold tools having a controlled movement.

Such an apparatus serves as a source of supply for a machine for filling and closing tuck-fold packages made of paper, cardboard or the like. The packages which it processes have on their internal and external surfaces a thermoplastic coating to protect the supporting material of the package against penetration by moisture. The plastic coating simultaneously serves, through appropriate heat treatment and the application of pressure, for sealing the bottom closure of the tubular package blank. Since the plastic coating serves in the areas of the closure for heat sealing as well as moisture-proofing, two factors are important in the achievement of a leak-proof package, namely the so-called "open time," during which the heated plastic coating must remain tacky, and the prevention of the destruction of the heat-softened coating material by the folding tools which move on the surfaces of the folding panels of the package, thus producing attrition.

Sealing machines for the production of bottoms on packages are known, in which tubular package blanks are mounted on the mandrels of a mandrel wheel and this mandrel wheel carries the mounted blanks stepwise to the individual stations equipped with the appropriate processing devices, the bottom parts of the tubular package blank being heated, creased, folded and sealed in the individual steps. This procedure has the disadvantage that, on account of the many steps necessary, a very high initial temperature is needed in order to render the plastic coating tacky, thereby creating the danger of overheating, which might impair the adhesive strength of the coating. Another kind of damage has also frequently been found due to relative movements of the folding tools on the surfaces of the folding panels, since the plastic coating is scraped off by the folding tools. In addition, the working edges of the folding tools become increasingly contaminated and thus no longer assure proper folding action. Also, the necessary cleaning of the tools requires that the machine be shut down. All these disadvantages are ultimately the cause of leaky packages, and they must be eliminated.

The invention is addressed to the problem of performing the folding process in the quickest possible manner, with adequate heating of the carton. In addition, the folding and sealing are to be executed in a single operation so as to prevent the folded panels from changing position during the sealing operation. The most important objective, however, is to avoid damage to the coating and to protect the working edges of the folding tools against contamination by the adhesive coating, so that a uniform, high quality fold will be made, resulting in a liquid-proof package having good stability due to its flat-folded bottom.

THE INVENTION

This problem is solved in accordance with the invention by the fact that the folding tools momentarily following the movement of the package during the folding action are so arranged and controlled by cams that no relative movement takes place between the working edges of the folding tools and the parts of the package on which they are acting.

The arrangement is furthermore such that both the tools for folding the end panels of the closure and the tools for folding the side panels of the closure are disposed within range of the movement of a mandrel between two successive stations, the end panel folding tools being disposed pivotingly in pairs on a shaft driven by the mandrel wheel, each tool having two arms and being provided at its extremity opposite the working end with a cam follower cooperating with a stationary cam.

In further development of the invention, the closure side panel folding tool is disposed pivotingly at the free end of a cam controlled angular lever, this tool being joined at its pivot point to cam follower lever having at its free end a cam follower wheel which is guided in a curved groove of finite length, the apparatus being so constructed that the working edge of the folding tool is located in the prolongation of the axis of rotation of the cam follower.

In the construction of the sealing plunger, the sealing face is equipped with lateral supporting means for the purpose of supporting the narrow sides of the package.

The advantages achieved with the invention consist especially in the fact that, due to the small interval between the closure end panel folding tools and the closure side panel folding tools, it has been made possible by the invention to perform the entire folding process within the shortest possible distance and thus within a minimum of time, and also within a single working step. Also, once the working edges of the folding tools have assumed their point of contact with the closure end panel, they do not change it during the folding action, so that no damage can be done to the still soft and tacky coating of the package. Another advantage is that the said tool edges do not become contaminated, and this manifests itself in a uniform, flat and square bottom on all of the packages.

An embodiment of the invention is represented in the drawing, and is described in detail hereinbelow.

Figure 5A:
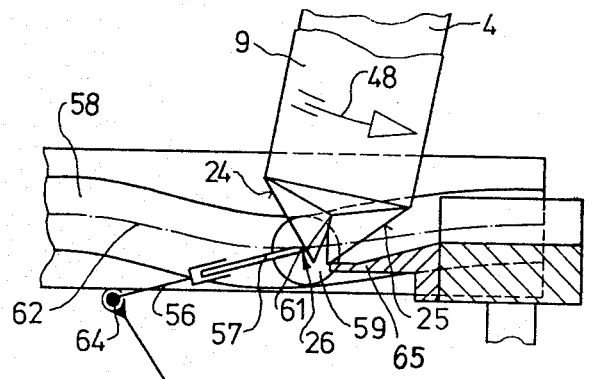
Figure 5B:
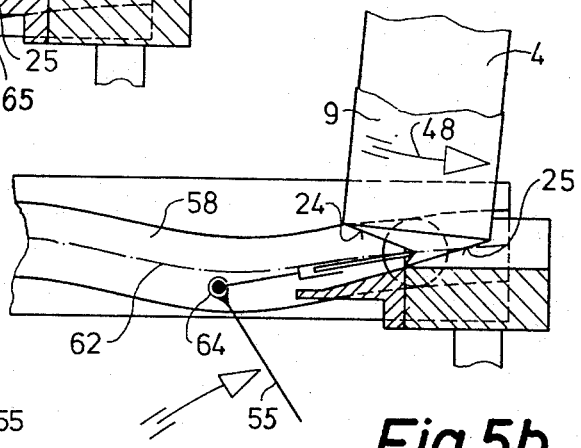
Figure 5C:
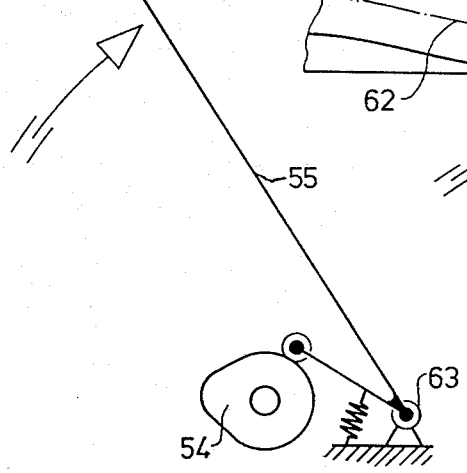
Figure 5C:
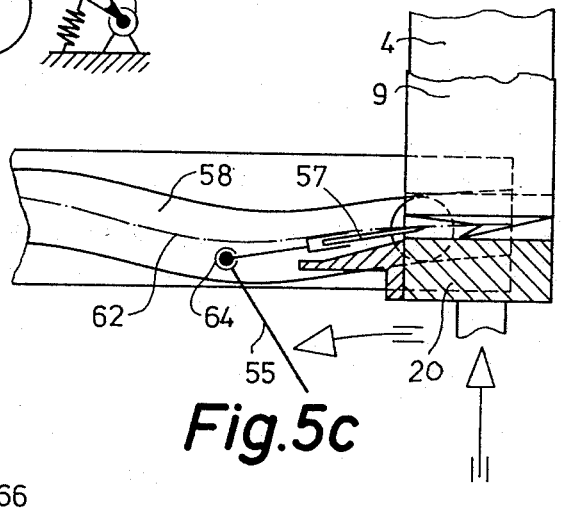
Figure 6:
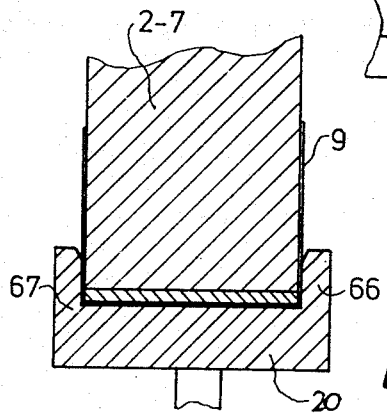

FIG. 1*a* is a general view of the mandrel wheel showing the arrangement of the folding tools, FIG. 1*b* is a top plan view of the cam controlling the tools which fold the tuck panels of the bottom closure, FIG. 2 is a diagrammatic representation of the process whereby the bottom is folded, FIGS. 3*a* and 3*b* are perspective views illustrating the engagement of the tuck panel folding tools, FIGS. 4*a* and 4*b* are perspective views illustrating the end position of the tuck panel folding tools, FIGS. 5*a* to 5*c* show the side panel folding tool in three different positions, and FIG. 6 is a cross sectional view of the sealing station.

As it can be seen in FIG. 1*a*, the sealing apparatus, of which only the mandrel wheel 1 is shown with the units cooperating directly with it, has six stations, I to VI, into which each mandrel 2 – 7 is moved, each having a package 8 – 11 drawn over it.

The manner of operation of the above-described sealing apparatus is as follows: In Station I the foremost tubular package blank 13 in stack 13 is singled out and opened up to its final cross-sectional configuration. The package 14 thus prepared is then pushed onto the empty mandrel of mandrel wheel 1. The next stepping action of the mandrel wheel 1 carries package 14 as well as packages 8 and 9 successively through the stations II and III in which the plastic coating on both sides in the bottom fold area 15, 16, 17, of the package is heated and thus rendered tacky by means of the heating heads 18 and 19. Between the stations III and IV, while the package is continuously advanced, first the folding in of the side panels of the closure takes place, and then the tuck folding of the end panels. This folding process is followed by the complete sealing flat of the bottom of the package by means of the sealing plunger 20 in station IV. In the next station V, the bottom-sealed package 11 is stripped from the mandrel 6 and placed on a conveyor 21 which then carries it to a filling machine, which is not shown. The final station VI in the processing circuit is an idle station which can be used for the cooling of the mandrels 2 to 7.

The folding process represented diagrammatically in FIG. 2 shows at *a* the open tubular package blank whose closure end panels 22 and 23 are increasingly tuck-folded inwardly at *b* and *c*. At *d*, the side panels 24 and 25 have just contacted one another at their edges. In this position the folding tool which folds the side panels makes contact with the crease 26 and bends the panel 24 inwardly along the crease. The side panel 24 is thereby pushed beneath side panel 25 which will then be on top of it; this can be seen at *e*. At *f* the package is shown with the bottom completely folded and sealed flat.

In FIGS. 3*a* to 4*b*, the folding movement of the end panel tuck-folding tools is represented in two positions. FIGS. 3*a* and 3*b* show the engagement of the package by the folding tool, and FIGS. 4*a* and 4*b* show the maximum depth of penetration of the folding tools into the bottom closure area 15, 16, 17, of the package, each in two different elevational views. The construction of the tuck-folding tool is described herewith: On a square shaft 29 driven by mandrel wheel 1 through gears 27 and 28, two tuck-folding tools 30 and 31 are pivotingly mounted. The working part of the tuck-folding tools 30 and 31 consists of the fingers 32 and 33, whose tips, which contact the intersection of the folding creases 34, 35 and 36, are of a rounded shape. At the extremities 37 and 38 opposite the fingers 32 and 33, respectively, on the double-armed tuck-folding tools 30 and 31, respectively, there are disposed the rounded cam follower wheels 39 and 40, respectively, which cooperate with a cam 42 disposed on a stationary crosspiece 41. A tension spring 43 urges the cam followers 39 and 40 constantly against the cam 42, so that the movement of the tuck-folding fingers 32 and 33 will be equal during each revolution of the shaft.

The manner of operation of the end panel tuck-folding device will now be described. The first contact between the gable or tuck-folding fingers 32 and 33 and the end panels 22 and 23, respectively, is intensified by the stationary cam 42 as the clockwise rotation of shaft 29 progresses (see also FIG. 1*b* ), since the tuck-folding fingers 32 and 33 are moved towards one another about the pivot points 44 and 45. This causes the end panels 22 and 23 to be folded inwardly along what will later be the bottom edges 46 nd 47 of the package. In FIGS. 4*a* and 4*b*, the cam followers 39 and 40 are in contact with the highest parts of the cam, bringing fingers 32 and 33 to their maximum depth of penetration, thus completing the inward folding of the end panels 22 and 23. Through the rotatory movement of the mandrel wheel 1, represented by arrow 48, and through the rotation of shaft 29, represented by arrow 50, and also through the cam-controlled inward movement of the tuck-folding tools 30 and 31, represented by the arrows 51 and 52, it has become possible for the tuck-folding fingers 32 and 33 to actually contact package 9 at only one point each throughout their entire movement, and thus avoid damaging the now tacky plastic coating.

After the tuck-folding operation is completed, the tool 53 (FIGS. 5*a*–*5c*) for the folding of the side or roof panels of the closure, which consists of cam 54, bell crank 55, lever 56 and folding blade 57, cam groove 58 and cam follower 59, is set in motion. Since during the folding process the package 9 is advanced virtually continuously, the side panel 24 undergoes an acceleration in its inward folding, which is imparted by the folding blade 57 controlled by cam 54. In order that the folding blade 57 may contact the side panel 24 along only one line, namely along the folding crease 26, during the entire folding process, without any relative movement, the working edge 61 of the folding blade 57 must follow a curved path, which is represented by the broken line 62. This additional movement of folding blade 57, which differs from the generally arcuate movement corresponding to the radius of the bell crank 55 about the pivot point 63, is produced by the cam follower wheel 59 which is guided in cam groove 58. For the transmission of the curvilinear movement of cam follower 59, the latter is connected to lever 56 at articulation 64 by means of a lever which lies parallel to said lever 56 and is concealed by the latter. Since the edge 61 of the folding blade 57 coincides precisely with the extended axis of rotation of cam follower 59, and line 62 is simultaneously the center line of the cam curve and the line of movement of edge 61, the movement of cam follower 59 is transferred to the folding blade in a ratio of 1:1.

The side panel folding process represented in FIGS. 5*a* to 5*c* is started by the twofold cam control of folding blade 57 when the side panel 24 is first contacted at folding crease 26 by edge 61. As the package 9 continues its advancement, represented by the arrow 48, the margin of the opposite side panel 25 comes in contact with a supporting means 65 which is stationary during the folding process. Side panel 25 is at first retarded by this contact to the same degree that the side panel 24 is accelerated, but as the folding action progresses the velocity ratios change, since now side panel 24 is bent along the folding crease 26, while side panel 25 undergoes no change of its shape (FIG. 5*b*).

In FIG. 5*c*, the folding of the bottom has been completed to such an extent that the folding blade 57 can be withdrawn and the sealing plunger 20 can be moved upwardly against the mandrel 4. Since the internal and external plastic coating on package 9 is still tacky, all of the doubled-over portions of the package are sealed together completely and flatly. After the sealing action has been completed, the mandrel wheel 1 steps one station further, causing the entire process described above to be repeated.

In FIG. 9 there is shown a cross section taken through a mandrel 2–7 and the sealing plunger 20, with package 9 in the position for sealing. Here it is possible to see how the sealing plunger 20 is provided with lateral plates 66 and 67 for the purpose of preventing the sides of package 9 from bulging outwardly on account of the junction between the multilayer folded closure and the single-layer package wall.

It will be appreciated that the instant specification and examples are set forth by way of illustration and not limitation, and that various modifications and changes may be made without departing from the spirit and scope of the present invention.

I claim:

1. An apparatus for the folding and flat sealing of the bottom of a liquid-proof package with a roof-shaped folded closure and inwardly folded gable walls starting with tubular package blanks, comprising a plurality of mandrels for carrying said blanks, means for advancing said mandrels progressively through a plurality of stations to be operated upon, means for effecting gable folding on said blanks, and means for effecting roof folding on each blank after a gable folding operation, said gable folding means and said roof folding means being positioned to operate on a blank in the course of the passage of said blank on a mandrel between two successive stations and each of said gable folding means and said roof folding means including blank contracting means and cam means controlling each of said blank contacting means, each cam means being shaped so that its respective blank contacting means after initially contacting a blank moves with said blank between said two successive stations and remains in contact therewith at the initially contacted location until said blank contacting means has completed its operation on said blank.

2. An apparatus according to claim 1, wherein said gable folding means includes a shaft driven with said mandrel advancing means, said blank contacting means comprising a pair of folding tools pivotingly connected to said shaft, each folding tool having a contact finger at one end and a cam follower at its other end, said cam means including a stationary cam which is contacted by said cam followers, whereby said folding tools pivot about their pivotal connections and said fingers move relative to their initial points of contact with said blank causing said blank to be folded with formation of gables.

3. An apparatus according to claim 2, wherein said roof folding means includes a bell crank lever, and a cam guiding one end of said bell crank lever, the other end of said bell crank lever being pivotingly connected to said roof folding blank contacting means, said roof folding cam means including a rotatable cam follower operatively connected with said roof folding blank contacting means and a cam track guiding said cam, whereby said cam causes said bell crank lever to pivot which in turn causes said cam-guided roof folding blank contacting means to move relative to its initial contact with said blank to effect said roof fold, said rotatable roof folding cam follower being operatively connected with said roof folding blank contacting means so that the blank contacting edge of said roof folding blank contacting means lies along the extended axis of rotation of said roof folding cam follower, said apparatus further including a U-shaped sealing plunger having two legs connected by a base and positioned adjacent the second of said two successive stations, and means for displacing said plunger toward a blank-carrying mandrel at said second station, whereby the legs of said plunger contact opposite sides of the folded package while the base of the plunger contacts the bottom of said package.

4. An apparatus according to claim 1, wherein said roof folding means includes a bell crank lever, and a cam guiding one end of said bell crank lever, the other end of said bell crank lever being pivotingly connected to said roof folding blank contacting means, said roof folding cam means including a cam follower operatively connected with said roof folding blank contacting means and a cam track guiding said cam, whereby said cam causes said bell crank lever to pivot which in turn causes said cam-guided roof folding blank contacting means to move relative to its initial contact with said blank to effect said roof fold.

5. An apparatus according to claim 4, wherein said roof folding cam follower is rotatable and is operatively connected with said roof folding blank contacting means so that the blank contacting edge of said roof folding blank contacting means lies along the extended axis of rotation of said roof folding cam follower.

6. An apparatus according to claim 1, including a U-shaped sealing plunger having two legs connected by a base and positioned adjacent the second of said two successive stations, and means for displacing said plunger toward a blank-carrying mandrel at said second station, whereby the legs of said plunger contact opposite sides of the folded package while the base of the plunger contacts the bottom of said package.

* * * * *